US009676514B1

(12) United States Patent
Gamez et al.

(10) Patent No.: US 9,676,514 B1
(45) Date of Patent: Jun. 13, 2017

(54) SECURE BARREL PALLET

(71) Applicants: Pete Gamez, Pleasanton, CA (US); Tim Hunt, Pleasanton, CA (US)

(72) Inventors: Pete Gamez, Pleasanton, CA (US); Tim Hunt, Pleasanton, CA (US)

( * ) Notice: Subject to any disclaimer, the term of this patent is extended or adjusted under 35 U.S.C. 154(b) by 0 days.

(21) Appl. No.: 15/280,440

(22) Filed: Sep. 29, 2016

Related U.S. Application Data

(60) Provisional application No. 62/234,101, filed on Sep. 29, 2015, provisional application No. 62/276,524, filed on Jan. 8, 2016.

(51) Int. Cl.
*B65D 19/44* (2006.01)
*B65D 19/06* (2006.01)

(52) U.S. Cl.
CPC ..... *B65D 19/06* (2013.01); *B65D 19/44* (2013.01); *B65D 2519/00273* (2013.01); *B65D 2519/00293* (2013.01); *B65D 2519/00323* (2013.01); *B65D 2519/00572* (2013.01); *B65D 2519/00796* (2013.01); *B65D 2519/00815* (2013.01)

(58) Field of Classification Search
CPC ..... B65D 19/00; B65D 19/38; B65D 19/44; B65D 2519/00547; A47B 87/00; A47B 87/002
USPC ..... 108/51.11, 54.1, 55.1, 55.3, 55.5, 57.13, 108/64, 56.1
See application file for complete search history.

(56) References Cited

U.S. PATENT DOCUMENTS 2,444,326 A * 6/1948 Baker ..... B65D 19/0026 108/55.3
3,096,555 A 7/1963 Gannaway
3,446,394 A 5/1969 Miller et al.
3,521,777 A 7/1970 Vik
3,677,436 A 7/1972 Danielson
3,834,323 A 9/1974 Weinmann
4,675,929 A * 6/1987 Santo ..... A47C 19/005 108/185
4,694,962 A * 9/1987 Taub ..... B65D 19/0073 108/185
4,829,909 A * 5/1989 Mandel ..... B65D 19/0012 108/54.1
4,876,841 A * 10/1989 Jensen ..... B65D 71/0096 108/55.1
5,105,746 A * 4/1992 Reynolds ..... B65D 19/0012 108/54.1
5,520,121 A * 5/1996 Schubart ..... B65D 19/0022 108/55.1
5,562,047 A * 10/1996 Forney ..... B65D 19/0002 108/24
5,636,753 A 6/1997 Wilkinson et al.
5,887,529 A * 3/1999 John ..... B65D 19/0018 108/56.1
6,216,607 B1 * 4/2001 Cuddy ..... B65D 19/0012 108/55.1
6,234,087 B1 * 5/2001 Brown ..... B65D 19/0034 108/55.1

(Continued)

*Primary Examiner* — Jose V Chen
(74) *Attorney, Agent, or Firm* — Robert C. Montgomery; Montgomery Patent & Design, LP.

(57) ABSTRACT

A pallet device for securing a barrel for transportation includes a first pallet half including a first semi-circular cut-out, a second pallet half including a second semi-circular cut-out, wherein the first pallet half and the second pallet half are connected together to form a circular cut-out configured to accommodate the barrel.

16 Claims, 4 Drawing Sheets

(56) References Cited

U.S. PATENT DOCUMENTS

| | | | | |
|---|---|---|---|---|
| 6,276,285 | B1 * | 8/2001 | Ruch | B65D 19/44 108/55.5 |
| 7,779,764 | B2 * | 8/2010 | Naidu | B65D 19/0095 108/56.1 |
| 7,802,527 | B2 * | 9/2010 | Dong | B65D 19/001 108/54.1 |
| 8,381,662 | B2 * | 2/2013 | Goldszer | A47B 37/04 108/25 |
| 8,505,469 | B2 * | 8/2013 | Liu | B65D 19/001 108/50.11 |
| 8,701,570 | B2 * | 4/2014 | Wilson | B65D 19/0016 108/54.1 |
| 8,875,638 | B2 * | 11/2014 | Luis y Prado | B65D 19/0012 108/55.5 |
| 9,392,868 | B2 * | 7/2016 | Nardi | A47B 13/16 |
| 2004/0255827 | A1 * | 12/2004 | de Barros, Jr. | B65D 19/44 108/55.1 |
| 2010/0251940 | A1 | 10/2010 | Jones et al. | |
| 2014/0265194 | A1 | 9/2014 | Gwin | |
| 2015/0375897 | A1 * | 12/2015 | Ness | B65D 19/02 108/55.3 |

* cited by examiner

SECURE BARREL PALLET

RELATED APPLICATIONS

The present invention claims the benefit of U.S. Provisional Application No. 62/234,101 filed on Sep. 29, 2016 and U.S. Provisional Application No. 62/276,524 filed on Jan. 8, 2016, the entire disclosures of which are incorporated herein by reference.

FIELD OF THE INVENTION

The present invention relates generally to shipping pallets for transportation of containers and, more particularly, to pallets for secure transportation of barrels or drums.

BACKGROUND OF THE INVENTION

A barrel, also referred to as a drum, is a cylinder shaped container used for shipping. Typically, most barrels are constructed of steel or plastic. Additionally, barrels are often certified for shipment of dangerous goods. The United States standard size for a barrel is fifty-five gallons (55 Gal). The United Kingdom standard size for a barrel is forty-four imperial gallons (44 Gal) for a nominal capacity of two hundred liters (200 L). Standard barrel sizes may vary by manufacturer, but are typically twenty-three inches (23 in.) in diameter at the top and bottom and thirty-four-and-a-half inch (34½ in.) in height.

A pallet is a flat transport device that supports materials being transported to and from various destination. Typically, a pallet is configured to be lifted by a forklift, pallet jack, front loader or other mechanical device, for example, using forks. Materials, including barrels, are often placed on the pallet and secured with straps, stretch wrap, or mechanical fasteners for shipping. Typically, pallets are generally constructed from wood or plastic. However, other materials, such as metal, paper, and recycled materials, can be used based on the type of material to be shipped and/or the shipping method.

Barrels are frequently transported on pallets for ease of lifting by a fork lift. One (1) limitation of shipping barrels by pallet is the need to secure the barrel to the pallet in order to ensure the barrel does not tip or spill during transport, which may present a safety hazard. Securing the barrel to the pallet with an auxiliary strap or other securement mechanisms often requires additional time, labor and cost.

Accordingly, there exists a need for barrel transportation device that addresses the disadvantages described above.

SUMMARY OF THE INVENTION

The inventor has recognized the aforementioned inherent problems and lack in the art and observed that there is a need for a device that improves the ability to ship barrels by pallet, while improving safety and reliability and reducing time, labor and costs. The development of the present invention, which will be described in greater detail herein, fulfills this need.

In an exemplary embodiment, the disclosed pallet device for securing a barrel for transportation includes a first pallet half including a first semi-circular cut-out, a second pallet half including a second semi-circular cut-out, wherein the first pallet half and the second pallet half are connected together to form a circular cut-out configured to accommodate the barrel.

In another exemplary embodiment, the disclosed pallet device for securing a plurality of barrels for transportation includes a first pallet half including a first semi-circular cut-out and a third semi-circular cut-out, a second pallet half including a second semi-circular cut-out and a fourth semi-circular cut-out, wherein the first pallet half and the second pallet half are connected together to form a first circular cut-out configured to accommodate one (1) of the barrels and a second circular cut-out configured to accommodate another one of the barrels.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
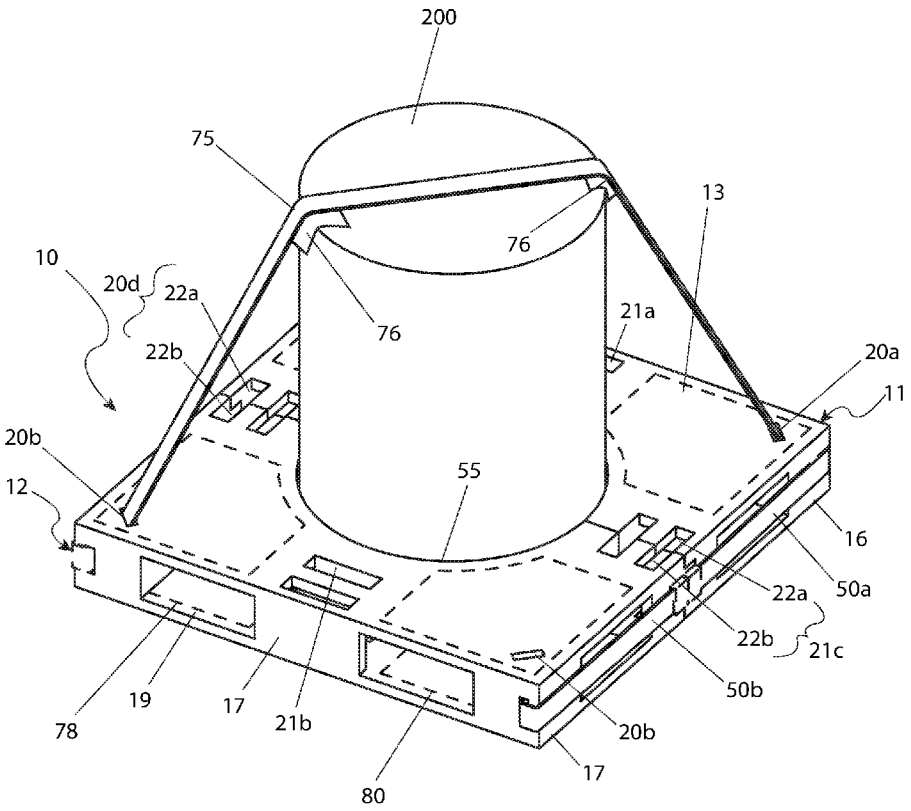
FIG. 1 is a top and side perspective view of an embodiment of the disclosed barrel pallet configured to transport a single barrel.

10 secure barrel pallet
11 first pallet half
12 second pallet half
13 first upper surface
14*a* first semi-circular cut-out
14*b* second semi-circular cutout
15 second upper surface
16 first sidewall
16*a* first one (1) of first sidewall
16*b* second one (1) of first sidewall
16*c* third one (1) of first sidewall
17 second sidewall
17*a* first one (1) of second sidewall
17*b* second one (1) of second sidewall
17*c* third one (1) of second sidewall
18 first lower surface
19 second lower surface
20*a* first corner slot
20*b* second corner slot
21*a* first intermediate slot
21*b* second intermediate slot
22*a* first intermediate slot half
22*b* second intermediate slot half

22*c* first intermediate slot
23*a* first sidewall slot
23*b* second sidewall slot
30 first connector
35 second connector
50*a* first side strap
50*b* seconds side strap
55 circular cut-out
56 first interface side
58 second interface side
75 upper strap
76 grabber
78 first four way entry opening
80 second four way entry opening
111 first pallet half
112 second pallet half
113 first upper surface
114*a* first semi-circular cut-out half
114*b* second semi-circular cut-out half
114*c* third semi-circular cut-out half
114*d* fourth semi-circular cut-out half
115 second upper surface
116 first sidewall
117 second sidewall
118 first lower surface
119 second lower surface
120*a* first corner slot
120*b* second corner slot
120*c* third corner slot
120*d* fourth corner slot
121*a* first intermediate slot
121*b* second intermediate slot
121*c* third intermediate slot
121*d* fourth intermediate slot
121*e* fifth intermediate slot
121*f* sixth intermediate slot
122*a* first intermediate slot half
122*b* second intermediate slot half
123*a* first sidewall slot
123*b* second sidewall slot
124*a* first combined slot
124*b* second combined slot
125*a* first center slot half
125*b* second center slot half
126 center slot
130 first connector
135 second connector
150*a* first side strap
150*b* second side strap
150*c* third side strap
150*d* fourth side strap
155*a* first circular cut-out
155*b* second circular cut-out
156 first interface side
158 second interface side
175 upper strap
176 grabber
178 first four way entry opening
180 second four way entry opening
200 barrel

DETAILED DESCRIPTION OF THE PREFERRED EMBODIMENT

In accordance with the invention, the best mode is presented in terms of exemplary embodiments, herein depicted within FIGS. 1-3 and FIGS. 4-6. However, the invention described herein is not limited to a single described embodiment and a person skilled in the art will appreciate that many other embodiments are possible without deviating from the basic concept of the disclosure and that any such work around will also fall under its scope.

Further, those skilled in the art will recognize that other styles and configurations can be incorporated into the teachings of the present disclosure, and that the example configurations shown and described herein are for the purpose of clarity and disclosure and not by way of limitation.

As used herein, the singular terms "a", "an", and "the" do not denote a limitation of quantity, but rather denote the presence of at least one (1), as well as a plurality of, the referenced items, unless the context clearly indicates otherwise.

Figure 2:
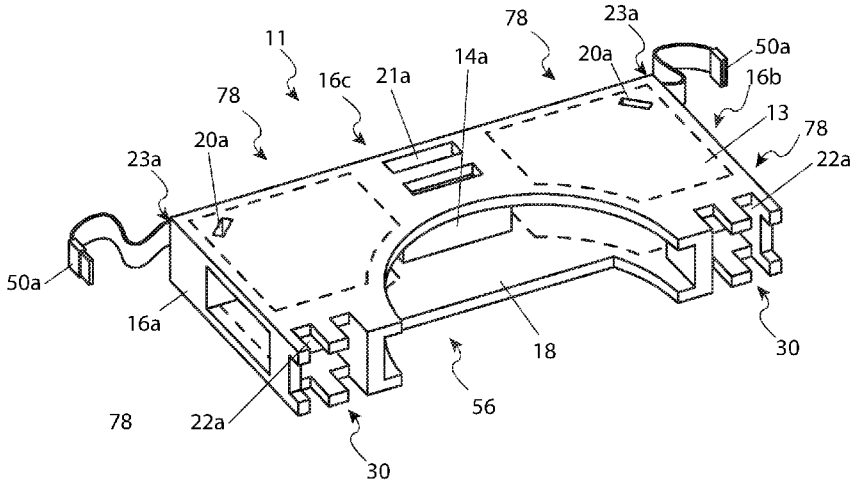
FIG. 2 is a top and side perspective view of a first pallet half of the barrel pallet of FIG. 1.
Figure 3:
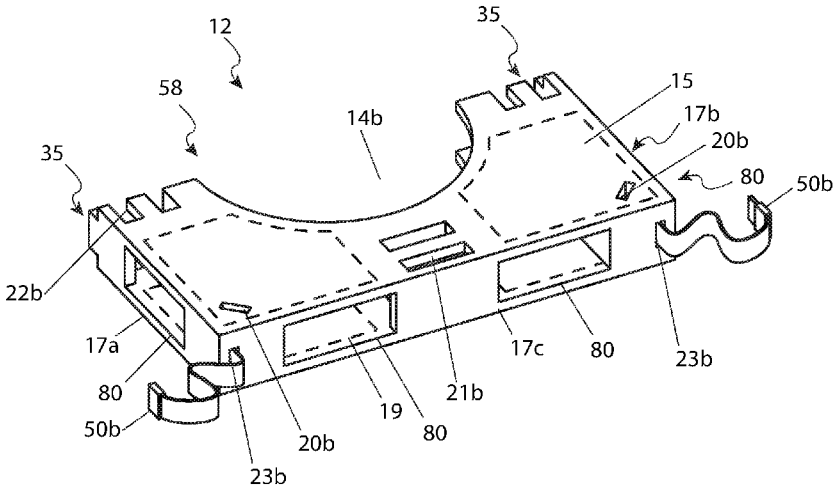
FIG. 3 is a top and side perspective view of a second pallet half of the disclosed barrel pallet of FIG. 1.
Figure 4:
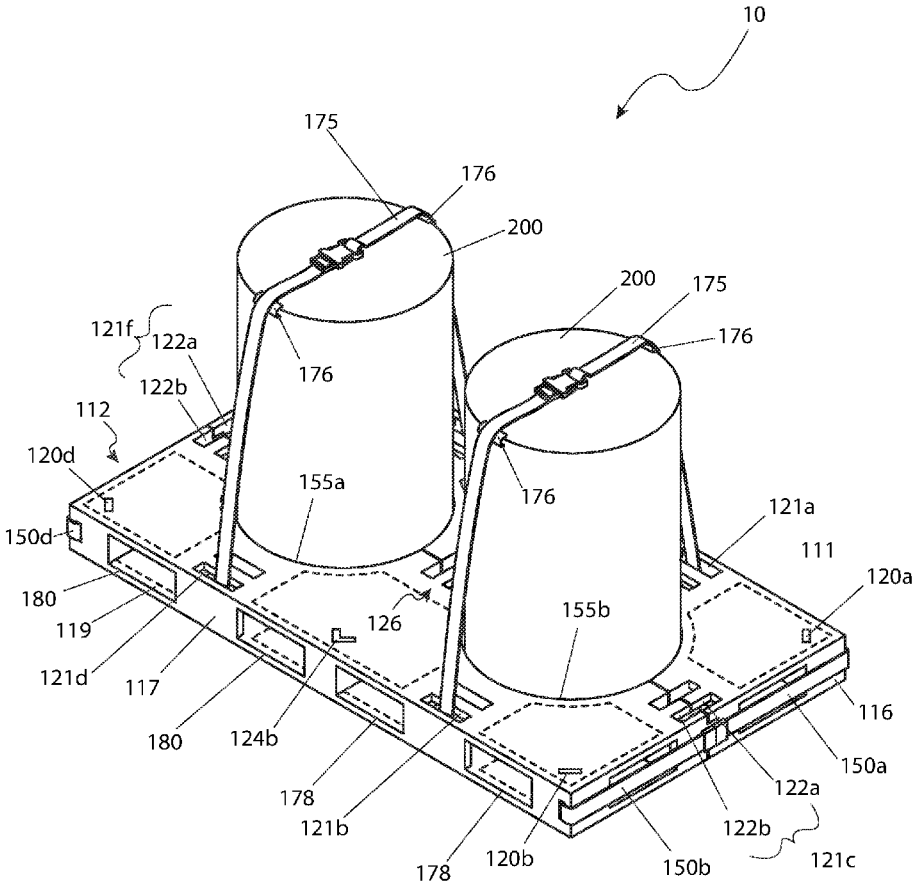
FIG. 4 is a top and side perspective view of another embodiment of the disclosed barrel pallet configured to transport a plurality of barrels.
Figure 5:
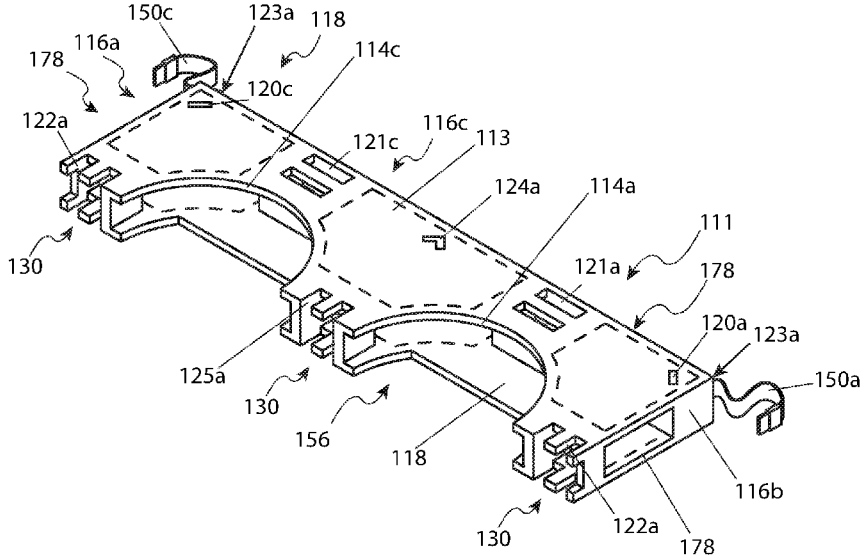
FIG. 5 is a top and side perspective view of a first pallet half of the disclosed barrel pallet of FIG. 4; and, FIG. 6 is a top and side perspective view of a second pallet half of the disclosed barrel pallet of FIG. 4.
Figure 6:
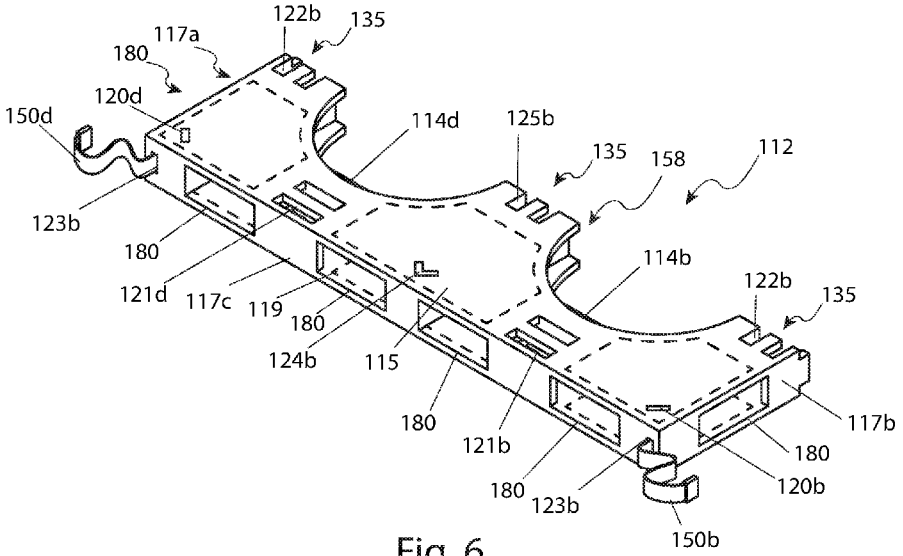

Referring to FIGS. 1-6, disclosing a secure barrel pallet, generally referred to herein as the device 10, where like reference numerals represent similar or like parts. The disclosed device 10 provides for the secure transportation of a barrel 200. In an exemplary embodiment, and as illustrated in FIGS. 1-3, the device 10 includes a first pallet half section 11, a second pallet half section 12, a pair of side straps 50*a*, 50*b*, and an upper strap 75. In another exemplary embodiment, and as illustrated in FIGS. 4-6, the device 10 includes a first pallet half section 111, a second pallet half section 112, two (2) pairs of side straps 150*a*, 150*b*, 150*c*, 150*d*, and a pair of upper straps 175.

FIG. 1 is a schematic illustration of a top and side perspective view of the disclosed device 10, according to an exemplary embodiment. As illustrated in FIG. 1, this illustrative embodiment of the device 10 is configured to support and secure one (1) barrel 200 for transport. Generally, the device 10 includes a first pallet half section 11 and a second pallet half section 12.

FIG. 2 is a schematic illustration of a top and side perspective view of the first pallet half 11 of the exemplary embodiment of the device 10 illustrated in FIG. 1. FIG. 3 is a schematic illustration of a top and side perspective view of the second pallet half 12 of the exemplary embodiment of the device 10 illustrated in FIG. 1. The first pallet half 11 includes a semi-circular cut-out 14*a* disposed in or located on one (1) side of the first pallet half 11. For example, the first semi-circular cut-out 14*a* may be a recess formed in a first interface side 56 of the first pallet half 11. Similarly, the second pallet half 12 includes a second semi-circular cut-out 14*b* disposed in or located on one (1) side of the second pallet half 12. For example, the second semi-circular cut-out 14*b* may be a recess formed in a second interface side 58 of the second pallet half 12.

Referring to FIGS. 1-3, the first pallet half 11 also includes three (3) first sidewalls 16, a first upper surface 13, and a first lower surface 18. Similarly, the second pallet half 12 includes three (3) second sidewalls 17, a second upper surface 15, and a second lower surface 19.

Referring to FIG. 1, when in an assembled condition, the two sections of the device 10, i.e., the first pallet half 11 and the second pallet half 12 are coupled together, such that the respective first semi-circular cut-out 14*a* (FIG. 2) and second semi-circular cut-out 14*b* (FIG. 3) fit snugly around the barrel 200. In other words, the first semi-circular cut-out 14*a* and the second semi-circular cut-out 14*b* combine to form a circular cut-out 55 (FIG. 1) configured (e.g., suitably sized and shaped) to receive and accommodate a lower end of the barrel 200. In the assembled condition, as illustrated in FIG. 1, the device 10 forms a substantially square shape formed by the first pallet half 11 and the second pallet half 12.

Referring to FIGS. 2 and 3, the first pallet half 11 includes a first connector 30 located at an end of a first one (1) of the first sidewalls 16*a* and an end of a second one (1) of the first sidewalls 16*b* located on the first interface side 56. Similarly, the second pallet half 11 includes a second connector 35 located at an end of a first one (1) of the second sidewalls 17*a* and an end of a second one (1) of the second sidewalls 17*b* located on the second interface side 58.

In an example embodiment, one (1) of the first connectors 30 includes a male connector portion for correspondingly mating with a female connector portion of an opposing one (1) of the second connectors 35. Another one (1) of the first connectors 30 includes a female connector portion for correspondingly mating with a male connector portion of an opposing another one (1) of the second connectors 35. In another example embodiment, both of the first connectors 30 include one (1) of the male connector portion or the female connector portion and both of the second connectors 35 include one (1) of a cooperative opposing female connector portion or male connector portion.

Referring again to FIGS. 1-3, a pair of first sidewall slots 23*a* are located on a third one (1) of the first sidewalls 16*c* opposing the first interface side 56. Each one (1) of the pair of first sidewall slots 23*a* is located at each opposing corner of the third one (1) of the first sidewalls 16*c* of the first pallet half 11 adjacent to the first one (1) of the first sidewalls 16*a* and the second one (1) of the first sidewalls 16*b*, respectively. Each first sidewall slot 23*a* is configured to or capable of receiving and securing a first end of a first side strap 50*a*. Similarly, a pair of second sidewall slots 23*b* are located on a third one (1) of the second sidewalls 17*c* opposing the second interface side 58. Each one (1) of the pair of second sidewall slots 23*b* is located at each opposing corner of the third one (1) of the second sidewalls 17*c* of the second pellet half 12 adjacent to the first one (1) of the second sidewalls 17*a* and the second one (1) of the second sidewalls 17*b*, respectively. Each second sidewall slot 23*b* is configured to or capable of receiving and securing a first end of the second side strap 50*b*. As best illustrated in FIG. 1, second ends of each of the first side strap 50*a* and the second side straps 50*b* correspondingly mate to further provide a secure coupling of the first pallet half 11 and the second pallet half 12.

Located at an intermediate position between both corners of the third one of the first sidewalls 16*c* of the first pallet half 11 is at least one (1) first intermediate slot 21*a* (FIG. 2). Similarly, located at an intermediate position between both corners of the third one (1) of the second sidewalls 17*c* of the second pallet half 12 is at least one (1) second intermediate slot 21*b* (FIG. 3). The first intermediate slot 21*a* and second intermediate slot 21*b* are capable of cooperatively receiving one (1) or more additional securing straps (not shown) therethrough.

When the first pallet half 11 is coupled to the second pallet half 12, at least one (1) first intermediate slot half 22*a* (FIG. 2) located to both sides of the first semi-circular cut-out 14*a* of the first pallet half 11 aligns with a corresponding second intermediate slot half 22*b* (FIG. 3) located to both sides of the second semi-circular cut-out 14*b* of the second pallet half 12 to form at least one (1) third intermediate slot 21*c* and at least one (1) fourth intermediate slot 21*d*, respectively (FIG. 1). Like the first intermediate slot 21*a* and second intermediate slot 21*b*, the third intermediate slot 21*c* and the fourth intermediate slot 21*d* are capable of cooperatively receiving one (1) or more additional securing straps (not shown) therethrough.

A pair of first corner slots 20*a* (FIG. 2) are located at corner locations of the first upper surface 13 adjacent to the corner intersections of the first one (1) of the first sidewalls 16*a* and the third one (1) of the first sidewalls 16*c* and the second one (1) of the first sidewalls 16*b* and the third one (1) of the first sidewalls 16*c*, respectively. Similarly, a pair of second corner slots 20*b* (FIG. 3) are located at corner locations of the second upper surface 15 adjacent to the corner intersections of the first one (1) of the second sidewalls 17*a* and the third one (1) of the second sidewalls 17*c* and the second one (1) of the second sidewalls 17*b* and the third one (1) of the second sidewalls 17*c*, respectively.

An upper strap 75 (FIG. 1) is affixed at each distal end to opposing pairs of the first and second corner slots 20*a*, 20*b* and over an upper end of the barrel 200 such that the upper strap 75 runs diagonally across the barrel 200 and the device 10 when in the assembled condition. The upper strap 75 may also be provided with rubber grabbers 76 on it to grip the edge of the barrel 200 along two (2) positions of an upper perimeter edge of the barrel 200.

Referring to FIGS. 2 and 3, a first end of the first lower surface 18 of the first pallet half 11 forming the first interface side 56 is not coextensive with the first upper surface 13 and terminates in a straight line as opposed to the first semi-circular cut-out 14*a*. In other words, at least a portion of a perimeter edge of the first lower surface 18 at the first interface side 56 extends beyond a perimeter edge of the first upper surface 13 at the first interface side 56. Similarly, a first end of the second lower surface 19 of the second pallet half 12 forming the second interface side 58 is not coextensive with the second upper surface 15 and terminates in a straight line as opposed to the second semi-circular cut-out 14*b*. In other words, at least a portion of a perimeter edge of the second lower surface 19 at the second interface side 58 extends beyond a perimeter edge of the second upper surface 15 at the second interface side 58. At least a portion of the perimeter edges of the first lower surface 18 and the second lower surface 19 come into contact when the first pallet half 11 is coupled to the second pallet half 12. Thus, at least a portion of the protruding portions of the first lower surface 18 and the second lower surface 19 provide a support surface or shelf to support and hold the barrel 200. In an example embodiment, the perimeter edges of the first lower surface 18 and the second lower surface 19 are straight. In another example, the perimeter edges of the first lower surface 18 and the second lower surface 19 are truncated to define a curved edge or C-shaped edge.

In an example embodiment, the device 10 may be designed to grip the barrel 200 such that it skids or is transported by a forklift as a single unit onto a truck (instead of tipping over). For example, a forty-three by forty-three-inch (43×43 in.) cut in may also be a half inch (½ in.) thick lip on the first lower surface 18 and the second lower surface 19 to lift and hold the barrel above the first lower surface 18 and the second lower surface 19.

Referring again to FIGS. 1-3, the first pallet half 11 also includes a first four way entry opening 78 extending from the first one (1) of the first sidewalls 16*a* through the body of first pallet half 11, between the first upper surface 13 and the first lower surface 18, and to the second one (1) of the first sidewalls 16*b* Similarly, the second pallet half 12 also includes a second four way entry opening 80 extending from the first one (1) of the second sidewalls 17*a* through the body of second pallet half 11, between the second upper surface 15 and the second lower surface 19, and to the second one (1) of the second sidewalls 17*b*. The first four way entry openings 78 and the second four way entry openings 80 are configured to receive the pair of forks of a fork lift for lifting and transporting the device 10 loaded with the barrel 200.

Additional first four way entry openings 78 may extend through the third one (1) of the first sidewalls 16*c* and cooperate with additional second four way entry openings 80 extending through the third one of the second sidewalls 17*c*.

FIG. 4 is a schematic illustration of a top and side perspective view of the disclosed device 10, according to another exemplary embodiment. As illustrated in FIG. 4, this illustrative embodiment of the device 10 is configured to support and secure a plurality of (e.g., two (2)) barrels 200 for transport. Generally, the device 10 includes a first pallet half section 111 and a second pallet half section 112.

FIG. 5 is a schematic illustration of a top and side perspective view of the first pallet half 111 of the exemplary embodiment of the device 10 illustrated in FIG. 4. FIG. 6 is a schematic illustration of a top and side perspective view of the second pallet half 112 of the exemplary embodiment of the device 10 illustrated in FIG. 4. The first pallet half 111 has a first pair of semi-circular cut-outs, identified as a first semi-circular cut-out 14*a* and third semi-circular cut-out 14*c* disposed in or located on one (1) side of the first pallet half 111. For example, the first semi-circular cut-out 14*a* and the third semi-circular cut-out 14*c* may be recesses formed in a first interface side 156 of the first pallet half 111. Similarly, the second pallet half 112 has a second pair of semi-circular cut-outs, identified herein as a second semi-circular cut-out 14*b* and a fourth semi-circular cut-out 14*d* disposed in or located on one (1) side of the second pallet half 112. For example, the second semi-circular cut-out 14*b* and the fourth semi-circular cut-out 14*d* may be recesses formed in a second interface side 158 of the second pallet half 112.

Referring to FIGS. 4-6, the first pallet half 111 also includes three (3) first sidewalls 116, a first upper surface 113, and a first lower surface 118. Similarly, the second pallet half 112 also includes three (3) second sidewalls 117, a second upper surface 115, and a second lower surface 119.

Referring to FIG. 4, when in an assembled condition, the two (2) sections of the device 10, i.e., the first pallet half 111 and the second pallet half 112 are coupled together, such that the respective first and second semi-circular cut-outs 14*a*, 14*b* (FIGS. 5 and 6) fit snugly around one (1) of the barrels 200. Similarly, the respective third and fourth semi-circular cut-outs 14*c*, 14*d* (FIGS. 5 and 6) fit snugly around another one (1) of the barrels 200. In other words, the first semi-circular cut-out 14*a* and the second semi-circular cut-out 14*b* combine to form a first circular cut-out 155*a* (FIG. 4) configured (e.g., suitably sized and shaped) to receive and accommodate a lower end of the barrel 200. Similarly, the third semi-circular cut-out 14*c* and the fourth semi-circular cut-out 14*d* combine to form a second circular cut-out 155*b* configured (e.g., suitably sized and shaped) to receive and accommodate a lower end of the other barrel 200. In the assembled condition, as illustrated in FIG. 4, the device 10 forms a substantially rectangular shape.

Referring to FIGS. 5 and 6, the first pallet half 111 includes a first connector 130 located at an end of a first one (1) of the first sidewalls 116*a* and an end of a second one (1) of the first sidewalls 116*b* located on the first interface side 156. Similarly, the second pallet half 111 includes a second connector 135 located at an end of a first one (1) of the second sidewalls 117*a* and an end of a second one (1) of the second sidewalls 117*b* located on the second interface side 158.

In an example embodiment, one (1) of the first connectors 130 includes a male connector portion for correspondingly mating with a female connector portion of an opposing one (1) of the second connectors 135. Another one (1) of the first connectors 130 includes a female connector portion for correspondingly mating with a male connector portion of an opposing another one (1) of the second connectors 135. In another example embodiment, both of the first connectors 130 include one (1) of the male connector portion or the female connector portion and both of the second connectors 135 include one (1) of a cooperative opposing female connector portion or male connector portion.

Referring again to FIGS. 4-6, a pair of first sidewall slots 123*a* are located on a third one (1) of the first sidewalls 16*c* opposing the first interface side 156. Each one (1) of the pair of first sidewall slots 123*a* is located at each opposing corner of the third one (1) of the first sidewalls 116*c* of the first pallet half 111 adjacent to the first one (1) of the first sidewalls 116*a* and the second one (1) of the first sidewalls 116*b*, respectively. Each first sidewall slot 123*a* is configured to or capable of receiving and securing one (1) of a first end of a first side strap 150*a* or a first end of a third side strap 50*c*. Similarly, a pair of second sidewall slots 123*b* are located on a third one (1) of the second sidewalls 117*c* opposing the second interface side 158. Each one (1) of the pair of second sidewall slots 123*b* is located at each opposing corner of the third one (1) of the second sidewalls 117*c* of the second pellet half 112 adjacent to the first one (1) of the second sidewalls 117*a* and the second one (1) of the second sidewalls 117*b*, respectively. Each second sidewall slot 123*b* is configured to or capable of receiving and securing one (1) of a first end of the second side strap 150*b* or a first end of a fourth side strap 150*d*. As best illustrated in FIG. 4, second ends of each of the first and second side straps 150*a*, 150*b*, as well as the second ends of each of the third and fourth side straps 150*c*, 150*d*, correspondingly mate to further provide a secure coupling of the first pallet half 111 and the second pallet half 112.

A first corner slot 120*a* and a third corner slot 120*c* (FIG. 5) are located at corner locations of the first upper surface 113 of the first pallet half 111 adjacent to the corner intersections of the first one (1) of the first sidewalls 116*a* and the third one (1) of the first sidewalls 116*c* and the second one (1) of the first sidewalls 116*b* and the third one (1) of the first sidewalls 116*c*, respectively. Similarly, a second corner slot 20*b* and fourth corner slot 20*d* (FIG. 6) are located at corner locations of the second upper surface 15 of the second sides of the second pallet half 112 adjacent to the corner intersections of the first one (1) of the second sidewalls 117*a* and the third one (1) of the second sidewalls 117*c* and the second one (1) of the second sidewalls 117*b* and the third one (1) of the second sidewalls 117*c*, respectively.

A first combined slot 124*a* (FIG. 5) is located equidistant between each corners of the first upper surface 113 of the first pallet half 111. Similarly, a second combined slot 124*b* (FIG. 6) is located equidistant between each corners of the second upper surface 115 of the second pallet half 112. The first combined slot 124*a* is fashioned as an angle pointing towards the second and fourth corner slots 120*b*, 120*d* of the second pallet half 112 (FIG. 6). The second combined slot 124*b* is each fashioned as an angle pointing towards the first and third corner slots 120*a*, 120*c* of the first pallet half 111 (FIG. 5).

Located at an intermediate position between the first corner slot 120*a* and the first combined slot 124*a* of the first pallet half 111 is at least one (1) first intermediate slot 121*a*. Located at an intermediate position between the third corner slot 120*c* and the first combined slot 124*a* of the first pallet half 111 is at least one (1) third intermediate slot 121*c*. Similarly, located at an intermediate position between the second corner slot 120*b* and the second combined slot 124*b* of the second pallet half 112 is at least one (1) second intermediate slot 121*b*. Located at an intermediate position between the fourth corner slot 120*d* and the second combined slot 124*b* of the second pallet half 112 is at least one (1) fourth intermediate slot 121*d*. The first intermediate slot 121*a* and second intermediate slot 121*b* are capable of cooperatively receiving one (1) or more additional securing straps (not shown) therethrough. The third intermediate slot 121*c* and fourth intermediate slot 121*d* are capable of cooperatively receiving one (1) or more additional securing straps (not shown) therethrough.

When the first pallet half 111 is coupled to the second pallet half 112, at least one (1) first intermediate slot half 122*a* (FIG. 5) located to both outer sides of the first semi-circular cut-out 114*a* and third semi-circular cut-out 114*c* of the first pallet half 111 aligns with a corresponding second intermediate slot half 122*b* located to both outer sides of the second semi-circular cut-out 114*b* and fourth semi-circular cut-out 114*c* of the second pallet half 112 to form at least one (1) fifth intermediate slot 121*e* and at least one (1) sixth intermediate slot 121*f*, respectively (FIG. 4). Similarly, at least one (1) first center slot half 125*a* (FIG. 5) located between the first semi-circular cut-out 114*a* and third semi-circular cut-out 114*c* of the first pallet half 111 aligns with a corresponding second center slot half 125*b* (FIG. 6) located between the second semi-circular cut-out 114*b* and fourth semi-circular cut-out 114*c* of the second pallet half 112 to form at least one (1) center slot 126 (FIG. 4). Like the first, second, third and fourth intermediate slots 121*a*, 121*b*, 121*c*, 121*d*, the fifth intermediate slot 121*e*, the sixth intermediate slot 121*e* and the center slot 126 are capable of cooperatively receiving one (1) or more additional securing straps (not shown) therethrough.

An upper strap 175 is capable of being affixed at each distal end to opposing pairs, as desired, of the first corner slot 120*a* and second combined slot 124*b*, the second corner slot 120*b* and first combined slot 124*a*, the third corner slot 120*c* and second combined slot 124*b*, the fourth corner slot 120*d* and second combined slot 124*b*, the first intermediate slot 121*a* and second intermediate slot 121*b*, the third intermediate slot 121*c* and fourth intermediate slot 121*d*, or combined intermediate slot halves 122*a*, 122*b* and combined center slot halves 124*a*, 124*b* over an upper end of each barrel 200 such that the upper strap 175 runs across the barrel 200 and the device 10 when in the assembled condition. The upper strap 175 may also be provided with rubber grabbers 176 on it to grip the edge of the barrel 200 on two (2) sides.

Referring to FIGS. 5 and 6, a first end of the first lower surface 118 of the first pallet half 111 is not coextensive with the first upper surface 113 and terminates in a straight line as opposed to the first and third semi-circular cut-outs 114*a*, 114*c*. In other words, at least a portion of a perimeter edge of the first lower surface 118 at the first interface side 156 extends beyond a perimeter edge of the first upper surface 113 at the first interface side 156. Similarly, a first end of the second lower surface 119 of the second pallet half 112 is not coextensive with the second upper surface 115 and terminates in a straight line as opposed to the second and fourth semi-circular cut-outs 114*b*, 114*d*. In other words, at least a portion of a perimeter edge of the second lower surface 119 at the second interface side 158 extends beyond a perimeter edge of the second upper surface 115 at the second interface side 158. At least a portion of the perimeter edges of the first lower surface 118 and the second lower surface 119 come into contact when the first pallet half 111 is coupled to the second pallet half 112. Thus, the protruding portions of the first lower surface 118 and the second lower surface 119 provide a support surface or shelf to support and hold the barrels 200. In an example embodiment, the perimeter edges of the first lower surface 118 and the second lower surface 119 are straight. In another example, the perimeter edges of the first lower surface 118 and the second lower surface 119 are truncated to define a curved edge or C-shaped edge.

In an example embodiment, the device 10 may be designed to grip a barrels 200 such that it skids or is transported, for example, by a forklift, as a single unit onto a truck (instead of tipping over). For example, a forty-three by forty-three-inch (43×43 in.) cut in may also be a half inch (½ in.) thick lip on the first and second bottom surfaces 118, 119 to lift and hold the barrels 200.

Referring again to FIGS. 4-6, the first pallet half 111 also includes at least one (1) first four way entry opening 178 extending from the first one (1) of the first sidewalls 116*a* through the body of first pallet half 111, between the first upper surface 113 and the first lower surface 118, and to the second one (1) of the first sidewalls 116*b*. Similarly, the second pallet half 112 also includes at least one (1) second four way entry opening 180 extending from the first one (1) of the second sidewalls 117*a* through the body of second pallet half 111, between the second upper surface 115 and the second lower surface 119, and to the second one (1) of the second sidewalls 117*b*. The first four way entry openings 178 and the second four way entry openings 180 are configured to receive the pair of forks of a fork lift for lifting and transporting the device 10 loaded with the barrel 200. Additional first four way entry openings 178 may extend through the third one (1) of the first sidewalls 116*c* and cooperate with additional second four way entry openings 180 extending through the third one (1) of the second sidewalls 117*c*.

Accordingly, in an exemplary embodiment, the disclosed device 10 includes a first pallet half 11 having a first side 56 and a second side, a first upper surface 13 having a first semi-circular first end 14*a*, a first lower surface 18 having a first truncated semi-circular first end, a pair of first lateral sidewalls 16*a*, 16*b*, a pair of first connectors 30 located at terminal ends of each of the pair of first lateral sidewalls 16*a*, 16*b* at the first side 56, a first rear wall 16*c*, a pair of first corner slots 20*a* located on the first upper surface 13 at a second side, at least one (1) first intermediate slot 21*a* each located equidistant between the pair of first corner slots 20*a* on the first upper surface 13, at least one (1) first intermediate slot half 22*a* located at a terminal edge of the first upper surface 13 at the first side 56, and a pair of first sidewall slots 23*a* located adjacent to corners of the first rear wall 16*c* at the second side. The device 10 also includes a second pallet half 12 having a first side 58 and a second side, a second upper surface 15 having a second semi-circular first end 14*b*, a second lower surface 19 having a second truncated semi-circular first end, a pair of second lateral sidewalls 17*a*, 17*b*, a pair of second connectors 35 located at terminal ends of each of the pair of second lateral sidewalls 17*a*, 17*b* at the first side 58, a second rear wall 17*c*, a pair of second corner slots 20*b* located on the second upper surface 15 at a second side, at least one (1) second intermediate slot 21*b* each located equidistant between the pair of second corner slots 20*b* on the second upper surface 15, at least one (1) second intermediate slot half 22*b* located at a terminal edge of the second upper surface 15 at the first side 58, and a pair of second sidewall slots 23*b* located adjacent to corners of the second rear wall 17*c* at the second side. The device 10 also includes a pair of first straps 50*a*, each having a first end secured within one (1) of the pair of first sidewall slots 23*a* and a pair of second straps 50*b*, each having a first end secured within one (1) of the pair of second sidewall slots 23*b*. The device also includes an upper strap 75. The first connector 30 correspondingly mates with the second connector 35 to connect the first pallet half 12 and the second pallet half 12 and provide the pallet 10. A second end of each of the pair of first straps 50*a* is removably secured to a second end of a corresponding one (1) of the pair of second straps 50*b*. Each first intermediate slot half 22*a* aligns with a corresponding second intermediate slot half 22*b* to create a continuous slot 21*c*, 21*d*. The upper strap 75 has distal ends capable of being secured to opposing ones of either the first and second corner slots 20*a*, 20*b*, any of the first and second intermediate slots 21*a*, 21*b*, and any of the continuous slots 21*c*, 21*d*. The first and second semi-circular first ends 14*a*, 14*b* of the first and second upper surface 13, 15 align with each other to create a barrel aperture 55. The first and second truncated semi-circular first ends of the first and second lower surface 18, 19 align with each other to create a shelf. The barrel aperture 55 is configured to receive a conventional 55-Gal drum 200. The shelf is capable of supporting the 55-Gal drum 200.

In another exemplary embodiment, the disclosed device 10 includes a first pallet half 111 having a first side 156 and a second side, a first upper surface 113 having a first end with a pair of first semi-circular cut-outs 114*a*, 114*c*, a first lower surface 118 having a first end with a pair of first truncated semi-circular cut-outs, a pair of first lateral sidewalls 116*a*, 116*b*, a pair of first connectors 130 located at terminal ends of each of the pair of first lateral sidewalls 116*a*, 116*b* at the first side 156, a first center connector 130 located between the pair of first semi-circular cut-outs 114*a*, 114*c*, a first rear wall 116*c*, a pair of first corner slots 120*a*, 120*c* located on the first upper surface 113 at the second side, a first combined slot 124*a* located equidistant between the pair of first corner slots 120*a*, 120*c*, at least one (1) pair of first intermediate slots 121*a*, 121*c* each located equidistant between the pair of first corner slots 120*a*, 120*c* and the first combined slot 124*a* on the first upper surface 113, at least one (1) first intermediate slot half 122*a* located at a terminal edge of the first upper surface 113 at the first side 156, a first center slot half 125*a* located between the pair of first semi-circular cut-outs 114*a*, 114*c*, and a pair of first sidewall slots 123*a* located adjacent to corners of the first rear wall 116*c* at the second side. The device 10 also includes a second pallet half 112 having a first side 158 and a second side, a second upper surface 115 having a first end with a pair of second semi-circular cut-outs 114*bm* 114*d*, a second lower surface 119 having a first end with a pair of second truncated semi-circular cut-outs, a pair of second lateral sidewalls 117*a*, 117*b*, a pair of second connectors 135 located at terminal ends of each of the pair of second lateral sidewalls 117*a*, 117*b* at the first side 158, a second center connector 135 located between the pair of second semi-circular cut-outs 114*b*, 114*d*, a second rear wall 117*c*, a pair of second corner slots 120*b*, 120*d* located on the second upper surface 115 at the second side, a second combined slot 124*b* located equidistant between the pair of second corner slots 120*b*, 120*d*, at least one (1) pair of second intermediate slots 121*b*, 121*d* each located equidistant between the pair of second corner slots 120*b*, 120*d* and the second combined slot 124*b* on the second upper surface 115, at least one (1) second intermediate slot half 122*b* located at a terminal edge of the second upper surface 115 at the first side 158, a second center slot half 125*b* located between the pair of second semi-circular cut-outs 114*b*, 114*d*, and a pair of second sidewall slots 123*b* located adjacent to corners of the second rear wall 117*c* at the second side. The device 10 also includes a pair of first straps 150*a*, 150*c*, each having a first end secured within one (1) of the pair of first sidewall slots 123*a* and a pair of second straps 150*b*, 150*d*, each having a first end secured within one (1) of the pair of second sidewall slots 123*b*. The device 10 also includes an upper strap 175. The first connectors 130 correspondingly mate with the second connectors 135 to connect the first pallet half 111 and the second pallet half 112 together and create the pallet 10. A second end of each of the pair of first straps 150*a*, 150*c* are removably secured to a second end of a corresponding one (1) of the pair of second straps 150*b*, 150*d*. Each first intermediate slot half 122*a* aligns with a corresponding second intermediate slot half 122*b* to create a continuous slot 121*e*, 121*f*. Each first center slot half 125*a* aligns with a corresponding second center slot half 125*b* to create a continuous slot 126. The upper strap 175 has distal ends capable of being secured to opposing ones of either the first and second corner slots 120*a*, 120*b*, 120*c*, 120*d*, any of the first and second intermediate slots 121*a*, 121*b*, 121*c*, 121*d*, and any of the continuous slots 121*e*, 121*f*, 126. Each of the pair of first and second semi-circular first ends 114*a*, 114*b*, 114*c*, 114*d* of the first and second upper surfaces 113, 115 align with each other to create a barrel aperture 115*a*, 115*b*. Each of the pair of the first and second truncated semi-circular first ends of the first and second lower surfaces 118, 119 align with each other to create a shelf. The barrel apertures 155*a*, 155*b* are configured to receive a conventional 55-Gal drum 200. The shelf is capable of supporting the 55-Gal drum 200.

The exact specifications, materials used, and method of use of the device 10 may vary upon manufacturing.

Those skilled in the art will recognize that other styles and configurations of the disclosed device 10 can be easily incorporated into the teachings of the present disclosure, and only particular configurations have been shown and described for purposes of clarity and disclosure and not by way of limitation of scope.

The foregoing descriptions of specific illustrated embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A pallet device for securing a barrel for transportation, said device comprising:

a first pallet half comprising a first semi-circular cut-out, an opposed pair of first connectors, and a first sidewall opposite said first semi-circular cut-out, said first sidewall having an opposed pair of first sidewall slots and a pair of first straps connected at an end to said pair of first sidewall slots;

a second pallet half comprising a second semi-circular cut-out, an opposed pair of first connectors, and a second sidewall opposite said second semi-circular cut-out, said second sidewall having an opposed pair of second sidewall slots and a pair of second straps connected at an end to said pair of second sidewall slots;

wherein said pair of first connectors matingly engage with said pair of second connectors to connect said first pallet half and said second pallet half together to form a circular cut-out configured to accommodate said barrel; and, wherein an opposing end of said pair of first straps are connected to an opposing end of said pair of second straps to further connect said first pallet half and said second pallet half together.

2. The device of claim 1, wherein:

said first pallet half further comprises a first upper surface, said first semi-circular cut-out is formed in said first upper surface, said second pallet half further comprises a second upper surface, and said second semi-circular cut-out is formed in said second upper surface.

3. The device of claim 2, wherein a first perimeter edge of said first upper surface defining said first semi-circular cut-out and a second perimeter edge of said second upper surface defining said second semi-circular cut-out are configured to circumferentially engage said barrel when said first pallet half and said second pallet half are connected together.

4. The device of claim 3, wherein:

said first pallet half further comprises a first lower surface, said second pallet half further comprises a second lower surface, a perimeter edge of said first lower surface and a perimeter edge of said second lower surface engage each other when said first pallet half and said second pallet half are connected together, and said barrel is supported on a combination of said first lower surface and said second lower surface.

5. The device of claim 1, further comprising an upper strap connected at an end to said first pallet half and connected at another end to said second pallet half, wherein said upper strap crosses over an upper end of said barrel.

6. The device of claim 5, wherein:

said first pallet half further comprises at least one first corner slot, said second pallet half further comprises at least one second corner slot, and said end of said upper strap is connected to said first corner slot and said another end of said upper strap is connected to said second corner slot.

7. The device of claim 5, wherein:

said first pallet half further comprises at least one first intermediate slot, said second pallet half further comprises at least one second intermediate slot, and said end of said upper strap is connected to said first intermediate slot and said another end of said upper strap is connected to said second intermediate slot.

8. The device of claim 1, wherein:

said first pallet half comprises a first four way entry opening formed through opposed first sidewalls of the first pallet half, said second pallet half comprises a second four way entry opening formed through opposed second sidewalls of the second pallet half, and said first four way entry opening and said second four way entry opening are configured to receive forks of a forklift.

9. A pallet device for securing a plurality of barrels for transportation, said device comprising:

a first pallet half comprising a first semi-circular cut-out and a third semi-circular cut-out, an opposed pair of first connectors, a first center connector, and a first sidewall opposite said first semi-circular cut-out and said third semi-circular cut-out, said first sidewall having an opposed pair of first sidewall slots and a pair of first straps connected at an end to said pair of first sidewall slots;

a second pallet half comprising a second semi-circular cut-out and a fourth semi-circular cut-out, an opposed pair of first connectors, a second center connector, and a second sidewall opposite said second semi-circular cut-out and said fourth semi-circular cut-out, said second sidewall having an opposed pair of second sidewall slots and a pair of second straps connected at an end to said pair of second sidewall slots;

wherein said pair of first connectors matingly engage with said pair of second connectors and said first center connector matingly engages with said second center connector to connect said first pallet half and said second pallet half together to form a first circular cut-out configured to accommodate one of said barrels and a second circular cut-out configured to accommodate another one of said barrels; and, wherein an opposing end of said pair of first straps are connected to an opposing end of said pair of second straps to further connect said first pallet half and said second pallet half together.

10. The device of claim 9, wherein:

said first pallet half further comprises a first upper surface, said first semi-circular cut-out and said third semi-circular cut-out are formed in said first upper surface, said second pallet half further comprises a second upper surface, and said second semi-circular cut-out and said fourth semi-circular cut-out are formed in said second upper surface.

11. The device of claim 10, wherein:

a portion of a first perimeter edge of said first upper surface defining said first semi-circular cut-out and a portion of a second perimeter edge of said second upper surface defining said second semi-circular cut-out are configured to circumferentially engage said one of said barrels when said first pallet half and said second pallet half are connected together, and another portion of said first perimeter edge of said first upper surface defining said third semi-circular cut-out and another portion of said second perimeter edge of said second upper surface defining said fourth semi-circular cut-out are configured to circumferentially engage said another one of said barrels when said first pallet half and said second pallet half are connected together.

12. The device of claim 11, wherein:

said first pallet half further comprises a first lower surface, said second pallet half further comprises a second lower surface, a perimeter edge of said first lower surface and a perimeter edge of said second lower surface engage each other when said first pallet half and said second pallet half are connected together, and said barrels are supported on a combination of said first lower surface and said second lower surface.

13. The device of claim 9, further comprising a pair of upper straps, each one of said pair of upper straps are connected at an end to said first pallet half and connected at another end to said second pallet half, wherein each one of said pair of upper straps crosses over an upper end of a respective one of said barrels.

14. The device of claim 13, wherein:

said first pallet half further comprises a pair of first corner slots, said second pallet half further comprises a pair of second corner slots, and said end of each one of said pair of upper straps is connected to one of said pair of first corner slots and said another end of each one of said pair of upper straps is connected to one of said second corner slots.

15. The device of claim 13, wherein:

said first pallet half further comprises a pair of first intermediate slots, said second pallet half further comprises a pair of second intermediate slots, and said end of each one of said pair of upper straps is connected to one of said pair of first intermediate slots and said another end of each one of said pair of upper straps is connected to one of said second intermediate slots.

16. The device of claim 9, wherein:

said first pallet half comprises a first four way entry opening formed through opposed first sidewalls of the first pallet half, said second pallet half comprises a second four way entry opening formed through opposed second sidewalls of the second pallet half, and said first four way entry opening and said second four way entry opening are configured to receive forks of a forklift.

* * * * *